US009032652B2

(12) United States Patent
Barker

(10) Patent No.: US 9,032,652 B2
(45) Date of Patent: May 19, 2015

(54) ROAD SIGN WITH LATERAL MEMBER

(71) Applicant: Arthur Samuel Barker, Red Deer (CA)

(72) Inventor: Arthur Samuel Barker, Red Deer (CA)

( * ) Notice: Subject to any disclaimer, the term of this patent is extended or adjusted under 35 U.S.C. 154(b) by 0 days.

(21) Appl. No.: 13/714,375

(22) Filed: Dec. 13, 2012

(65) Prior Publication Data

US 2014/0165437 A1 Jun. 19, 2014

(51) Int. Cl.

| | |
|---|---|
| ***G09F 7/18*** | (2006.01) |
| ***G09F 7/00*** | (2006.01) |
| ***G09F 19/12*** | (2006.01) |
| ***E01F 9/011*** | (2006.01) |

(52) U.S. Cl.

CPC *G09F 7/00* (2013.01); *G09F 19/12* (2013.01); *G09F 7/18* (2013.01); *G09F 2007/1878* (2013.01); *E01F 9/011* (2013.01)

(58) Field of Classification Search

CPC ..... G09F 7/00; G09F 7/18; G09F 13/16; E01F 9/012; E01F 9/0113

USPC ..... 40/612

See application file for complete search history.

(56) References Cited

U.S. PATENT DOCUMENTS

| | | | | | |
|---|---|---|---|---|---|
| 1,355,036 | A | * | 10/1920 | De Witt | 40/612 |
| 2,074,280 | A | * | 3/1937 | Smith | 40/612 |
| 2,849,816 | A | * | 9/1958 | Locke | 40/612 |
| 3,256,625 | A | * | 6/1966 | Nelson | 40/1 |
| 4,117,455 | A | * | 9/1978 | Cervantes | 340/908 |
| 4,137,662 | A | * | 2/1979 | Baumer | 40/612 |
| D305,212 | S | * | 12/1989 | Rowebottom | D10/109.1 |
| 7,156,044 | B1 | * | 1/2007 | Davis | 116/28 R |
| 7,827,715 | B2 | | 11/2010 | Thissen | |
| 2002/0100408 | A1 | * | 8/2002 | Fricano | 116/63 R |
| 2014/0054386 | A1 | * | 2/2014 | McKinnon | 235/494 |

* cited by examiner

*Primary Examiner* — Casandra Davis
(74) *Attorney, Agent, or Firm* — Sander R. Gelsing

(57) ABSTRACT

A road sign, for viewing by primary traffic and right-angled traffic comprises a sign plate having a first indicia representative of the sign's message directed to the primary traffic and a lateral member having a second indicia. In a preferred embodiment, the lateral member has suitable dimensions, is suitably positioned relative to the sign plate and has suitable second indicia so as to give the appearance, when viewed by right-angled traffic, that a portion of the sign plate was bent substantially perpendicular to the sign's normal orientation along substantially the vertical axis of the sign. Additional embodiments are also provided.

2 Claims, 7 Drawing Sheets

ROAD SIGN WITH LATERAL MEMBER

FIELD OF THE INVENTION

The present invention relates generally to road signs and, more particularly, to a road sign and road sign attachments that can be easily viewed from the side.

BACKGROUND OF THE INVENTION

The background information discussed below is presented to better illustrate the novelty and usefulness of the present invention. This background information is not admitted prior art.

Typical road, street, highway or traffic control signs (referred to herein simply as road signs) are comprised of one or more posts carrying a sign plate mounted on the upper end thereof (see FIG. 1*a*). The sign plate normally carries indicia on one side thereof to convey the sign's meaning or message, with the other side thereof being typically blank and containing no indicia. A sign's indicia may include wording (e.g. "STOP" or "YIELD), a pictorial symbol, a particular colour scheme or a combination thereof. The indicia bearing side will herein be referred to as the road sign's front side while the other side will be referred to as the road sign's rear side.

Road signs are normally arranged or mounted with the sign's front side disposed at right angles to the roadway on which the sign is positioned. The indicia carried on the front side is thus visible to traffic on said roadway so that the sign's message is conveyed or directed to that traffic (referred to herein as primary traffic). Because typical road signs have a sign plate which is generally planar, only the narrow edge of the road sign is visible to traffic which may be operating at right angles to the roadway, or which may be intersecting with the roadway, on which the road sign is placed (see FIGS. 1*b* and 1*c* for such side views of a typical road sign). The indicia of the road sign is normally not easily seen by such traffic that is moving at substantially right angles to the roadway, or intersecting with the roadway (such traffic referred to hereinafter as right-angled traffic).

This is has not usually a problem, because different signs may be placed or arranged so as to convey a different meaning to such right-angled traffic. For example, a stop sign may be positioned with the sign's front side disposed at right angles to the roadway which carries the primary traffic that will need to stop at a specific point; e.g. at an intersection. Therefore such primary traffic can clearly see the road sign's indicia and determine the sign's meaning. Right-angled traffic that may approach such intersection, however, may have the right-of-way and will not need to stop at such intersection. Therefore, it is normally not a problem that such right-angled traffic cannot see the indicia of the road sign positioned for the primary traffic.

However, in certain instances, it would be advantageous to have the sign's indicia or message (as directed to the primary traffic) also be visible from the substantially the side and/or to right-angled traffic. For example, in parking lots or at entrance ways to public buildings (such as at hospitals and the like) the roadways are often convoluted, circular, winding and generally unfamiliar. In such cases it would be helpful for right-angled traffic to know what the sign's message was to the primary traffic; for example, so that drivers in such right-angled traffic can determine who has the right-of way in such unfamiliar environment. Likewise, at traffic circles or at rural intersections (where both roads may be gravel) it is difficult to tell who has the right-of-way. In those cases too, it would be advantageous to have the sign's indicia or message (to the primary traffic) also be visible from the side and/or to right-angled traffic.

As mentioned, certain roadways may create uncertainty to a motorist as to who has the right-of-way (e.g. traffic circles or rural intersections). In such cases, a motorist may approach the intersection (wherein he or she may have the right-of-way) too cautiously and too slowly, thereby inadvertently signal to another motorist (who may be facing a yield or stop sign) that it is okay for such other motorist to proceed, when in fact it was not. This confusion (as to whether or not a slow moving right-angled traffic motorist approaching an intersection has the right-of-way) may result in vehicular accidents.

It is therefore desirable to have a road sign that can convey the message of said road sign to right-angled traffic, without giving the impression that the sign's message is also applicable to said right-angled traffic.

There is very little in the prior art to address this need. In U.S. Pat. No. 2,849,816, Locke discloses a traffic control sign with a smaller replica of the sign on top of and perpendicular to the main sign. Traffic approaching perpendicular to the road controlled by the main sign is not expected to respond to the small sign, so the coloring is not standard and indicia may be omitted. Moreover, because this replica is smaller, is not standard and is not positioned at a level where a motorist is conditioned to look for a road sign (because it projects well above the main sign), such a road sign may not be easily seen or interpreted by right-angled traffic.

In U.S. Pat. No. 7,827,715, Thissen discloses a multi-sided hand-held sign which includes two substantially planar panels having a preselected shape interlocking substantially perpendicularly at a common central vertical axis. Indicia typical of signs held by school crossing guards are disposed on all the planar surfaces of the planar sign panels. Although this sign is easily viewable by right-angled traffic (because the interlocking panels are of the same size and all planar surfaces bear the same indicia), the message that will be conveyed to such right-angled traffic will be the same as the message that is conveyed to the primary traffic. As such, motorist in any right-angled traffic may obey the sign's message when, in fact, such motorist need not do so (e.g. he or she has the right-of-way). This is undesirable, when what that is needed is to merely provide information (to motorists in right-angled traffic) as to road sign's message as directed to the primary traffic.

Therefore, what is needed is a road sign, or a road sign attachment, which conveys the sign's message to right-angled traffic, without giving the impression that such message is also applicable to said right-angled traffic. Preferably such road sign, or road sign attachment, is simple in design, may be easily retro-fit to existing road signs and does not have the above-mentioned disadvantages.

SUMMARY OF THE INVENTION

The present invention is directed to overcoming the prior art deficiencies in road signs which do not easily convey the sign's message to right-angled traffic.

In one aspect the invention provides a road sign, for viewing by both primary traffic and right-angled traffic, which comprises a sign plate having a first indicia representative of the sign's message directed to the primary traffic and a lateral member having a second indicia. In a preferred embodiment, the lateral member has suitable dimensions, is suitably positioned relative to the sign plate and has suitable second indicia so as to give the appearance, when viewed by right-angled traffic, that a portion of the sign plate was bent substantially perpendicular to the sign's normal orientation along substantially the vertical axis of the sign. In another embodiment, the second indicia is substantial reproduction of a portion of the first indicia.

In another aspect, the invention provides an attachment for a road sign, the road sign having a first indicia representative of the sign's message directed to primary traffic, the attachment comprising a lateral member having a second indicia visible to right-angled traffic and wherein the second indicia is substantially a portion of the first indicia. Advantageously, the attachment can be retrofit to existing road signs.

BRIEF DESCRIPTION OF THE DRAWINGS

Referring to the drawings, several aspects of the present invention are illustrated by way of example, and not by way of limitation, in detail in the figures, wherein.

DETAILED DESCRIPTION OF THE PREFERRED EMBODIMENTS

Figure 1A:
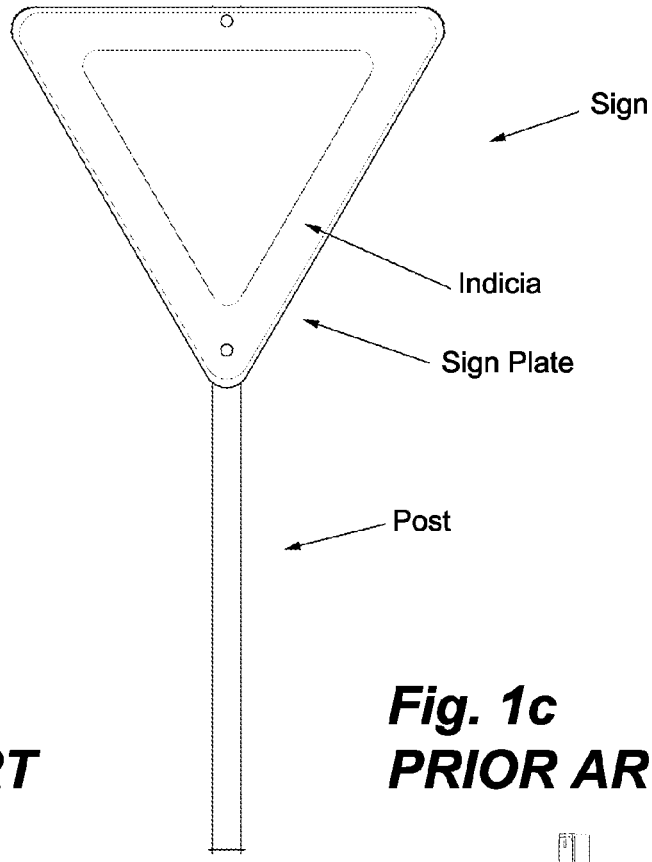
Fig. 1a PRIOR ART
FIG. 1*a* is a front view of a PRIOR ART road sign.
Figure 1B:
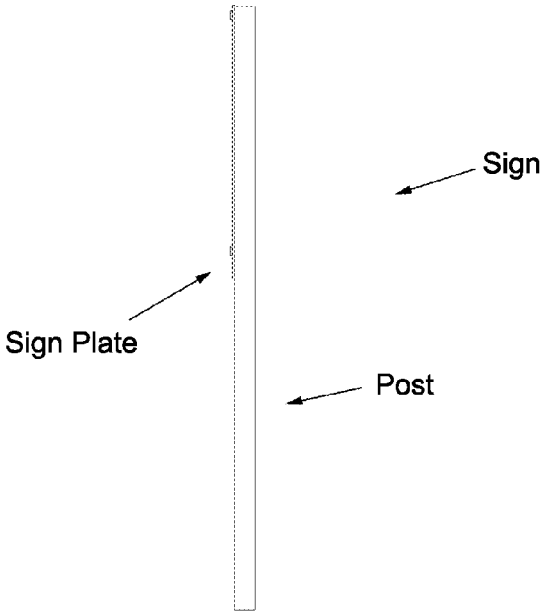
Fig. 1b PRIOR ART
FIG. 1*b* is a side view of the PRIOR ART road sign of FIG. 1*a;*
Figure 1C:
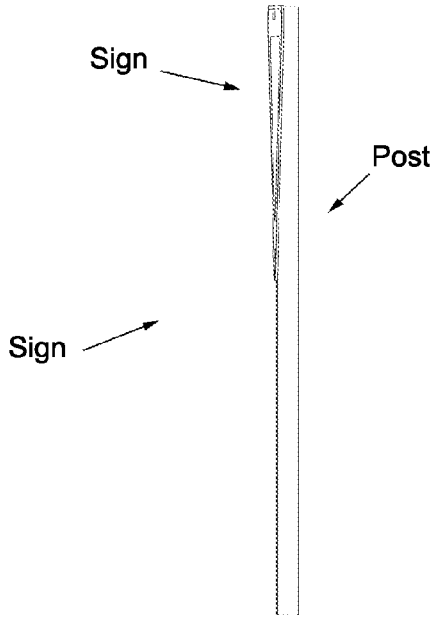
Fig. 1c PRIOR ART
FIG. 1*c* is a side perspective view of the PRIOR ART road sign of FIG. 1*a;*

The following description is of preferred embodiments by way of example only and without limitation to the combination of features necessary for carrying the invention into effect. Reference is to be had to the Figures in which identical reference numbers identify similar components. The drawing figures are not necessarily to scale and certain features are shown in schematic or diagrammatic form in the interest of clarity and conciseness.

In accordance with a first embodiment of the present invention, and as shown generally in FIGS. 2*a*-2*d*, there is a provided a road sign 10 having a sign plate 10*p* of generally planar proportions as is customary with conventional road signs. The sign plate 10*p* further comprise indicia 12 representative of the sign's meaning or message that is to be conveyed to primary traffic. In this embodiment, the sign plate 10*p* is a thin member in the shape of an inverted equilateral triangle. The indicia 12 of this embodiment comprises the colours red 12*r* and white 12*w* according to the international standard for a yield sign. The indicia 12 preferably comprises reflective elements, as may be customary for such road sign 10. The road sign 10 is preferably secured to, or mounted on, a sign post 14 in a conventional manner. However, the road sign 10 may also be secured to a building, wall or other object (not shown), as may be applicable, using conventional mounting hardware.

The road sign 10 of the present invention further comprises a lateral member 20, having two planar faces 20' and 20", mounted to the sign 10 or its post 14. The lateral member 20 in this embodiment further comprises a mounting edge 20*m* having a planar configuration which is oriented substantially perpendicular to the lateral member's planar faces 20', 20" (as more clearly shown in FIG. 2*b*) and said mounting edge 20*m* facilitates the mounting of lateral member 20 to the road sign 10. The lateral member 20 is mounted (to the sign 10) substantially perpendicular to the sign plate 10*p* via mounting edge 20*m*, as more clearly shown in the Figures. In the embodiment of FIGS. 2*a*-2*d* the lateral member 20 is mounted to the rear portion of the post 14 by means of screws 16 driven through mounting edge 20*m* and into the post 14 (see FIG. 2*b*), but other conventional mounting means or fasteners, such as rivets, bolts, appropriately placed strips of adhesive-backed hook and loop fasteners (e.g. Velcro™ fasteners), gluing or welding may be utilized. It is also contemplated that in another embodiment (not shown), the sign plate 10*p* and lateral member 20 are constructed of a unitary member (such as by bending a lateral portion of an oversized sign plate at a right angle to the planar face of such oversized sign plate during construction, so as to create a lateral member from the oversized portion while still maintaining substantially normal proportions and dimensions of the remainder of the sign plate that faces the primary traffic).

The lateral member 20 further comprises indicia 22 on at least one of the member's planar faces 20' and 20". Preferably, the indicia 22 on the lateral member 20 is substantially a portion of the indicia 12 on the sign plate 10*p*; e.g. if the sign plate indicia 12 are comprised of the colours red 12*r* and white 12*w* according to the international standard for a yield sign, then the lateral member's indicia 24 preferably likewise comprises the colours red 22*r* and white 22*w* proportionally according to the international standard for a yield sign. More preferably, the lateral member 20 is of substantially the same height H as the height H of the sign plate 10*p* and is mounted (to the sign 10) at substantially the same level L above the ground as the sign plate 10*p* (see FIG. 2*a*). Even more preferably, the lateral member 20 has suitable outline dimensions and indicia 22 so as to give the appearance, when at least one of the member's planar faces 20' and 20" having the indicia 22 is viewed by right-angled traffic, that a portion of the sign plate 10*p* was bent substantially perpendicular (to the sign plate 10*p*) along substantially the vertical axis of the sign 10.

Preferably, although not shown in the figures, indicia 22 are provided on both faces 20' and 20". More preferably, the lateral member 20 is mounted at substantially the same level L above the ground as the sign plate 10*p*, is substantially the same height H as the sign plate 10*p*, and has such dimensions and indicia 22 so as to give the appearance, to right-angled traffic, that anywhere from a 5% to a 70% portion of the sign plate 10*p* was bent substantially perpendicular to the sign plate's normal orientation (and so as to then face said right-angled traffic). Yet even more preferably, the lateral member 20 is mounted behind the sign plate 10*p*, although it is contemplated in another embodiment (not shown) that the lateral member is mounted to the sign plate's front side.

Being larger than 70% of the portion of the sign plate 10*p* is not desirable since, once the lateral member 20 starts to look more like a full sign, the right-angled traffic may interpret the lateral member 20 as a primary sign that is directed to them (instead of to the primary traffic). Additionally, being smaller than 5% of the portion of the sign plate 10*p* is also not desirable, since this results in the lateral member not being easily visible to said right-angled traffic. Preferably, the lateral member 20 is of such dimensions so as to give the appearance, to right-angled traffic, that anywhere from a 15% to a 25% portion of the sign plate 10*p* was bent substantially perpendicular to the sign plate's normal orientation. This results in the lateral member not likely to be mistaken (by right-angled traffic) for a primary sign that is directed at right-angled traffic and also still being sufficiently visible to such right-angled traffic, so as to allow it to quickly and easily understand the message on the road sign 10 that is directed to the primary traffic. Preferably, the indicia 22 further comprises similar reflective elements to those that would be present in the indicia 12 of said sign plate 10*p*.

Figure 2A:
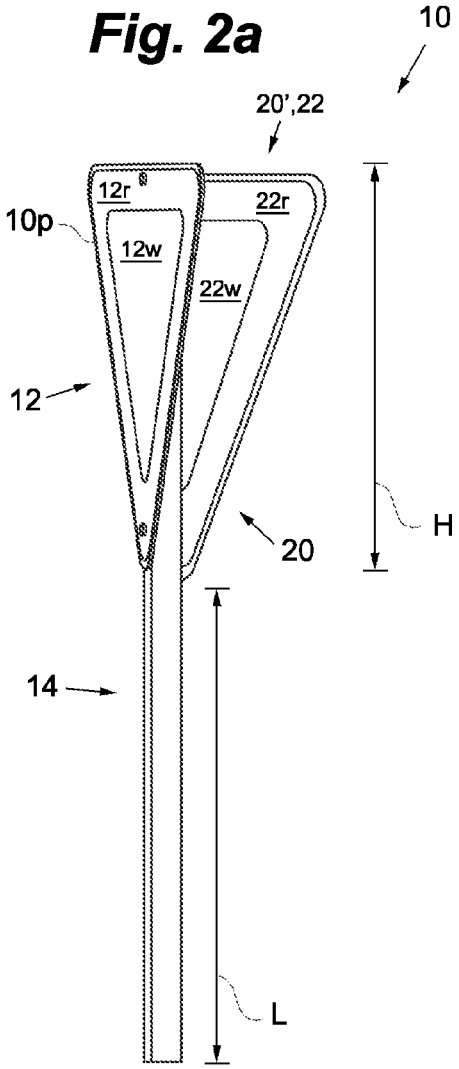
FIG. 2*a* is a frontal-side perspective view of a first embodiment of a road sign according to the present invention.
Figure 2B:
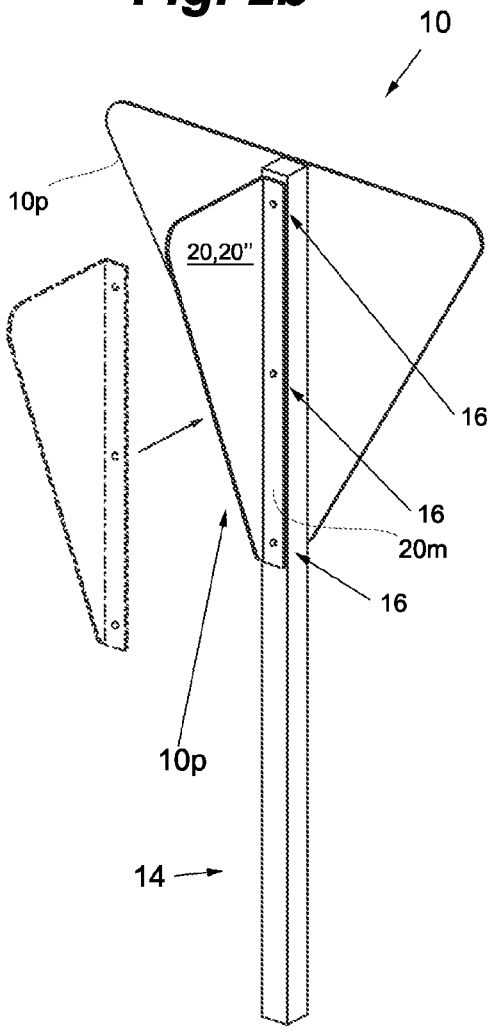
FIG. 2*b* is a rear perspective view of embodiment of FIG. 2*a*, with the lateral member also shown in an exploded view to illustrate mounting of the lateral member to the road sign.
Figure 2C:
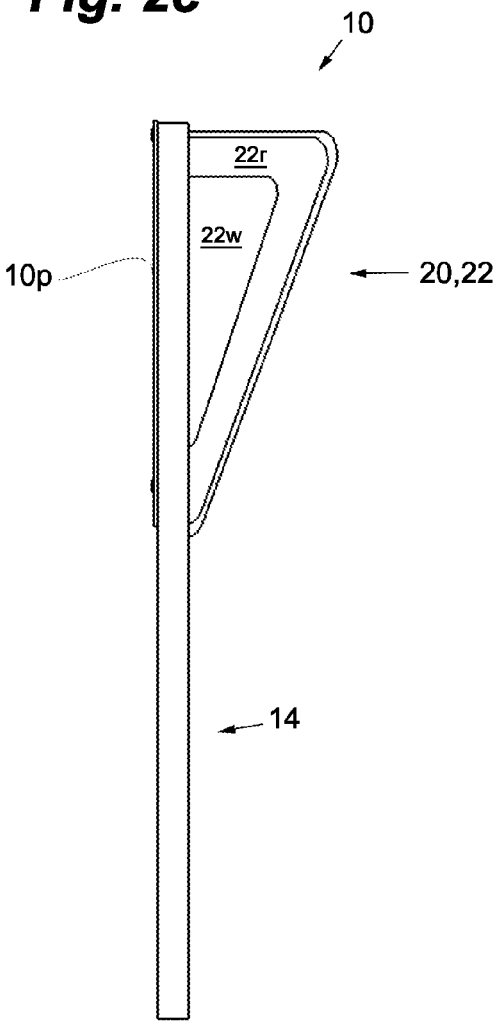
FIG. 2*c* is a side view of embodiment of FIG. 2*a;*
Figure 2D:
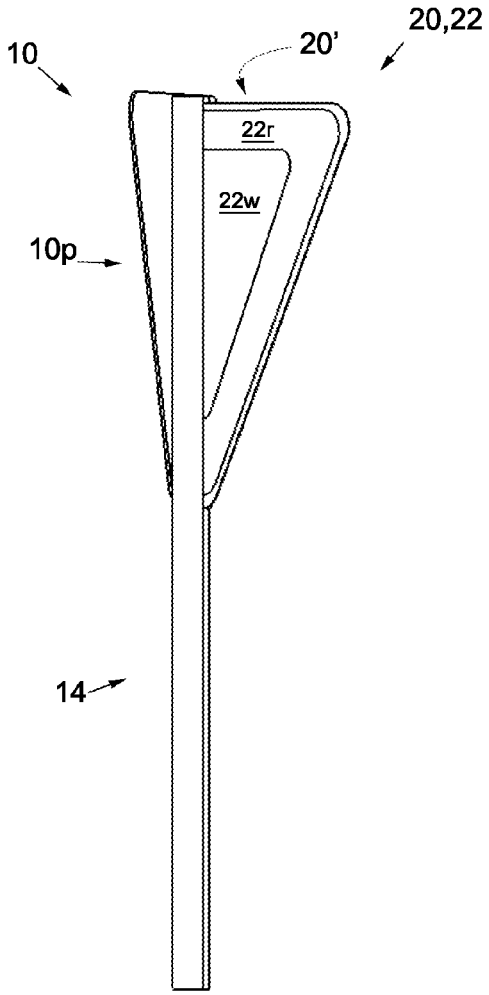
FIG. 2*d* is a side-rear perspective view of embodiment of FIG. 2*a;*

In the embodiment of FIGS. 2*a*-2*d*, the lateral member 20 is in the shape of half an inverted equilateral triangle and further comprises indicia 22 on both faces 20' and 20" (although said indicia is not shown on face 20" in FIG. 2*b*). The indicia 22 comprises the colours red 22*r* and white 22*w* according to the international standard for a yield sign (as would be applied to a corresponding half portion of a yield sign). As such, the lateral member 20, gives the appearance to right-angled traffic (approaching the sign from substantially either side) that approximately 25% to 30% of a standard yield sign's plate 10*p* was bent substantially perpendicular to the sign plate's normal orientation (see FIGS. 2*c* and 2*d*).

Advantageously, because the sign 10 of the present invention gives the appearance (to right-angled traffic) that a portion of the sign plate 10*p* was bent substantially perpendicular to the sign plate's normal orientation, two concepts are conveyed to such right-angled traffic. These concepts are: (i) that the sign 10 itself is not normally directed to the right-angled traffic, but rather to primary traffic (because of the bent or partial appearance of the lateral member 20); and (ii) the actual meaning or message of the sign 10 as directed to primary traffic (because of the similarity of the indicia 22 on the lateral plate 20 to that of the indicia 12 on the sign plate 10*p*). More advantageously, because the lateral member 20 is mounted at substantially the same level L above the ground as the sign plate 10*p* and is substantially the same height H as the sign plate 10*p*, a motorist's eye will be automatically drawn to the sign's lateral plate 20 (as compared to having to look for another plate mounted above the sign, as is the case in U.S. Pat. No. 2,849,816. to Locke). Even more advantageously, and in contrast to the small replica as disclosed in U.S. Pat. No. 2,849,816. to Locke, because the indicia 22 on the lateral member 20 uses the same standard colouring so as the match the indicia 12 on the sign plate, a motorist will quickly understand and interpret the sign's message (as directed to primary traffic).

Advantageously, because the lateral member 20 provides the appearance that only a portion of the sign plate 10*p* was bent, a motorist in right-angled traffic will not normally feel the need to actually obey the sign's message, as is the case with the sign in U.S. Pat. No. 7,827,715 to Thissen. Yet even more advantageously, because the road sign 10 still has a sign plate 10*p* that is normally directed to primary traffic, a motorist in such primary traffic will understand that the sign's message is directed at him or her. Still even more advantageously, because the lateral member 20 is mounted behind the sign plate 10*p*, it is not visible to primary traffic and therefore does not distract from the sign's message as conveyed to said primary traffic.

Still even more advantageously, a lateral member 20 having suitable indicia 22 can be retrofit to an existing road sign by being mounted to such existing road sign; in a manner such as described above with respect to mounting to the sign 10 of the embodiment of FIGS. 2*a*-2*d*. Advantageously, such lateral member 20 having suitable indicia 22 can thereby simply and easily convert said existing road sign to a road sign 10 according to the present invention.

Other Embodiments

Figure 3A:
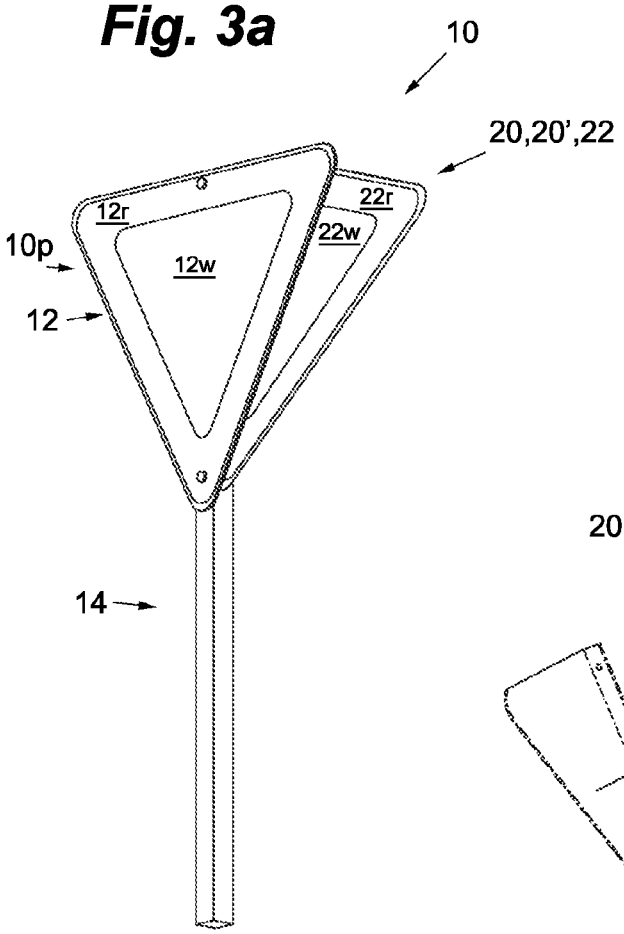
FIG. 3*a* is a frontal-side perspective view of a another embodiment of a road sign according to the present invention.
Figure 3B:
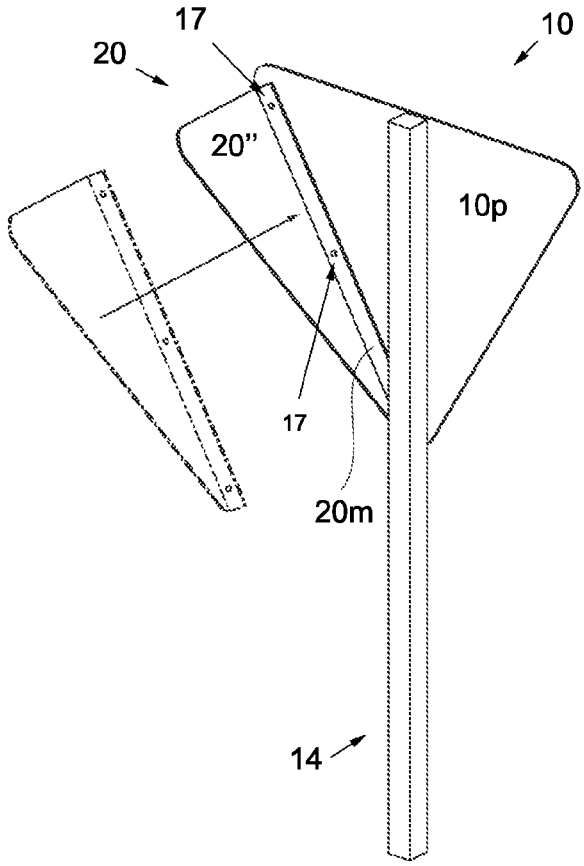
FIG. 3*b* is a rear perspective view of embodiment of FIG. 3*a*, with the lateral member also shown in an exploded view to illustrate mounting of the lateral member to the road sign.

Another embodiment of the road sign 10 is shown in FIGS. 3*a*-3*b*. In this embodiment of the road sign 10, like that of the embodiment of FIGS. 2*a*-2*d*, the sign plate 10*p* is a thin member in the shape of an inverted equilateral triangle and has indicia 12 comprising the colours red 12*r* and white 12*w* according to the international standard for a yield sign. The lateral member 20 of this second embodiment, like the first embodiment, is in the shape of half an inverted equilateral triangle and further comprises indicia 22 having the colours red 22*r* and white 22*w* according to the international standard for a yield sign (as would be applied to a corresponding half of a yield sign). Unlike the first embodiment, however, the lateral member 20 member in this embodiment is preferably mounted directly to one lateral edge of the sign plate 10*p* using rivets 17 (as more clearly shown in FIG. 3*b*). As such, the lateral member 20 of this second embodiment, also gives the appearance to right-angled traffic (approaching the sign 10 from the side where the lateral member 20 is mounted) that approximately 25% to 30% of a standard yield sign's plate 10*p* was bent substantially perpendicular to the sign plate's normal orientation.

In another embodiment (not shown, but very similar to the embodiment of FIGS. 3*a*-3*b*), two lateral members 20 are provided and which members 20 are then mounted to one and the other lateral edges of the sign plate 10*p* so as to give the appearance to right-angled traffic (approaching the sign 10 from either side) that approximately 25% to 30% of a standard yield sign's plate 10*p* was bent substantially perpendicular to the sign plate's normal orientation, at each side.

Figure 4A:
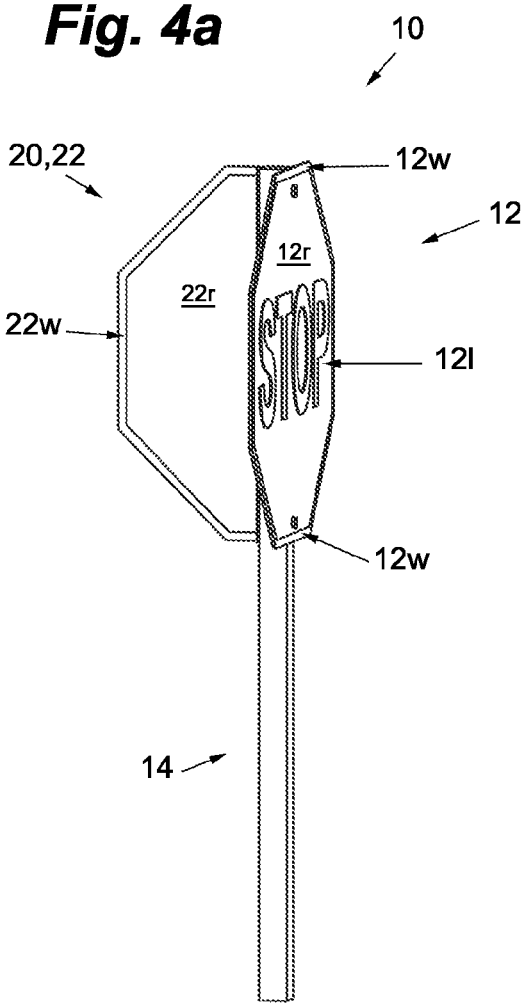
FIG. 4*a* is a frontal-side perspective view of a yet another embodiment of a road sign according to the present invention.
Figure 4B:
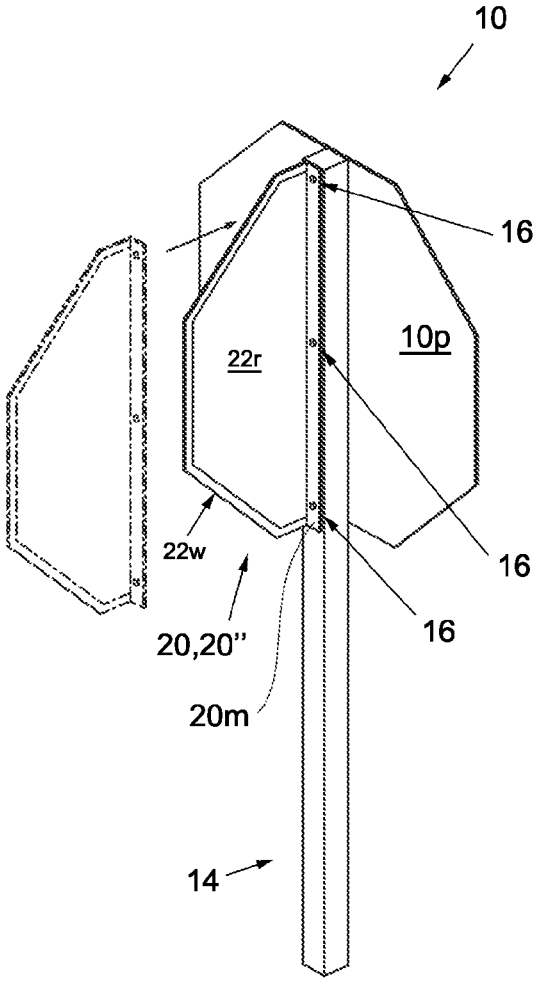
FIG. 4*b* is a rear perspective view of embodiment of FIG. 4*a*, with the lateral member also shown in an exploded view to illustrate mounting of the lateral member to the road sign.

Yet another embodiment of the road sign 10 is shown in FIGS. 4*a*-4*b*. In this embodiment of the road sign 10, the sign plate 10*p* is a thin member in the shape of an octagon and has indicia 12 comprising the colours red 12*r* and white 12*w* according to the international standard for a stop sign, i.e. white letters 12*l* spelling STOP on a red background 12*r* with a white border 12*w*. The lateral member 20 of this second embodiment is in the shape of half an octagon and further comprises indicia 22, on both faces 20' and 20" having the colours red 22*r* and white 22*w* substantially according to the international standard for a stop sign (as would be applied to a corresponding half of a stop sign); corresponding lettering spelling a partial "STOP" may also form part of the indicia 22 of this embodiment (although not shown in the drawings). Like the first embodiment, the lateral member 20 in this embodiment is mounted to the post 14 by means of screws 16 (see FIG. 4*b*). As such, the lateral member 20 of this embodiment gives the appearance to right-angled traffic (approaching the sign 10 from either side) that approximately 50% of a standard stop sign's plate 10*p* was bent substantially perpendicular to the sign plate's normal orientation.

Figure 5A:
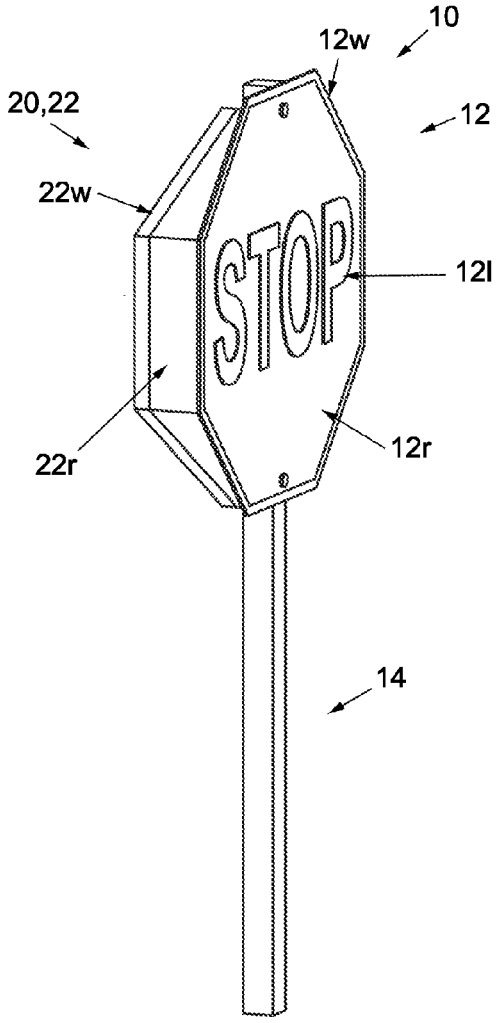
FIG. 5*a* is a frontal-side perspective view of a further embodiment of a road sign according to the present invention.
Figure 5B:
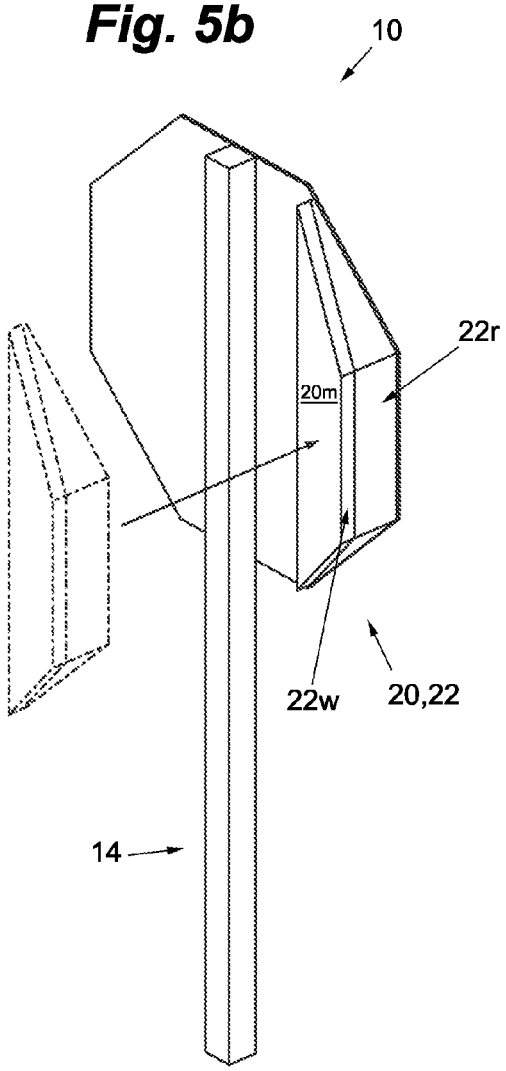
FIG. 5*b* is a rear perspective view of embodiment of FIG. 5*a*, with the lateral member also shown in an exploded view to illustrate mounting of the lateral member to the road sign

Yet a further embodiment of the road sign 10 is shown in FIGS. 5*a*-5*b*. In this embodiment of the road sign 10, like that of the embodiment of FIGS. 4*a*-4*b*, the sign plate 10*p* is a thin member in the shape of an octagon and has indicia 12 comprising the colours red 12*r* and white 12*w* according to the international standard for a stop sign. The lateral member 20 of this second embodiment, is approximately 15% to 20% of a standard stop sign's plate and further comprises indicia 22 having the colours red 22*r* and white 22*w* according to the international standard for a stop sign. Unlike the embodiment of FIGS. 4*a*-4*b*, however, the lateral member 20 member in this embodiment is preferably mounted directly to one lateral edge of the sign plate 10*p* using appropriately placed strips of adhesive-backed hook and loop fasteners (e.g. Velcro™ fasteners, not shown). As such, the lateral member 20 of this embodiment, also gives the appearance to right-angled traffic (approaching the sign 10 from the side where the lateral member 20 is mounted) that approximately 15% to 20% of a standard stop sign's plate 10*p* was bent substantially perpendicular to the sign plate's normal orientation.

Figure 6A:
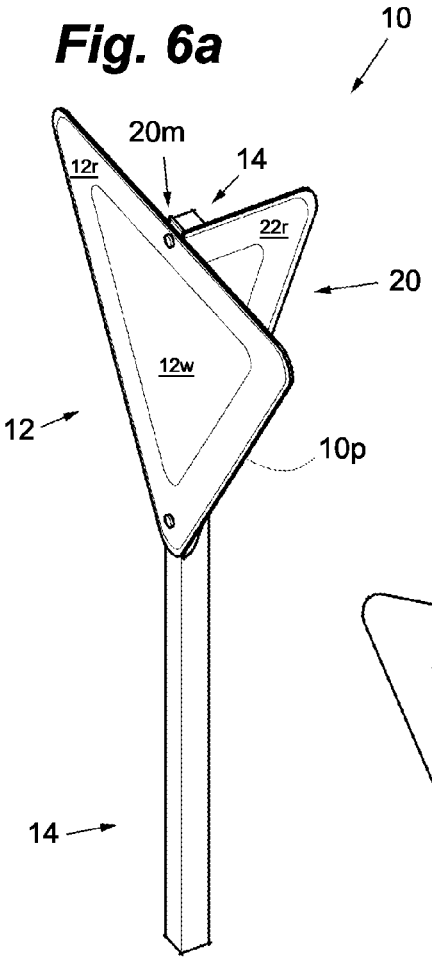
FIG. 6*a* is a frontal-side perspective view of another embodiment of a road sign according to the present invention.
Figure 6B:
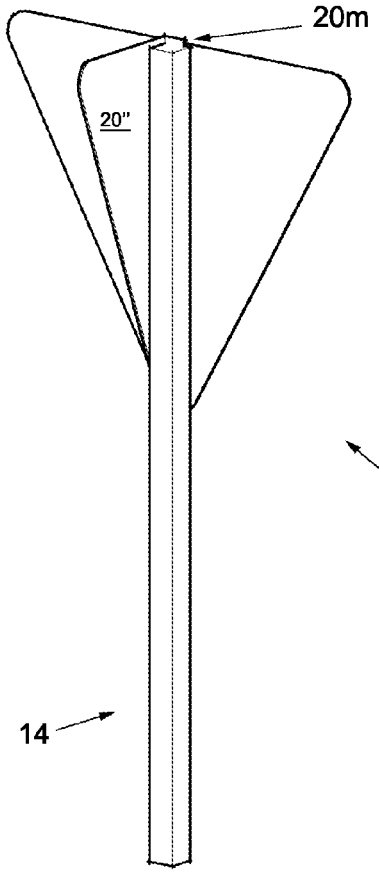
FIG. 6*b* is a rear perspective view of embodiment of FIG. 6*a*.
Figure 6C:
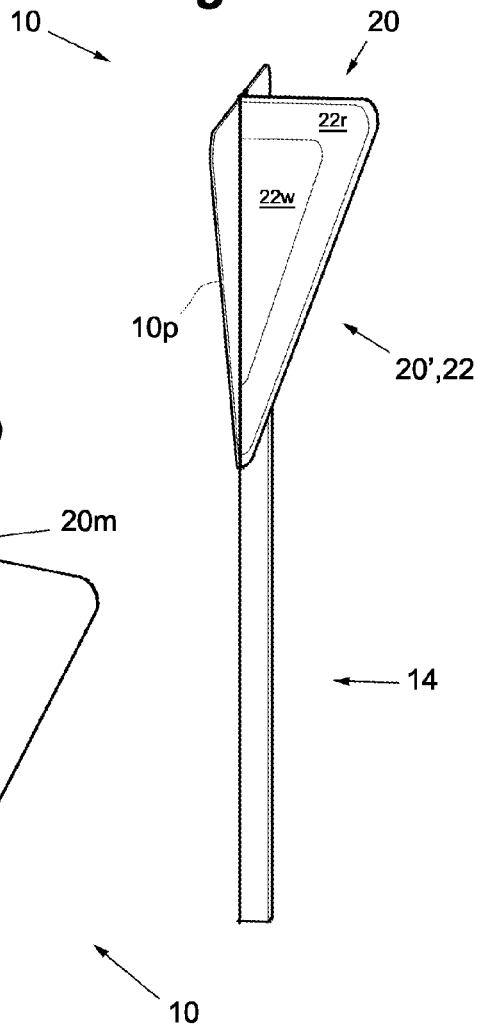
FIG. 6*c* is a side perspective view of embodiment of FIG. 6*a*.

Still another embodiment of the road sign 10 is shown in FIGS. 6*a*-6*c*. In this embodiment of the road sign 10, like that of the embodiment of FIGS. 2*a*-2*d*, the sign plate 10*p* is a thin member in the shape of an inverted equilateral triangle and has indicia 12 comprising the colours red 12*r* and white 12*w* according to the international standard for a yield sign. The lateral member 20 of this second embodiment, like the first embodiment, is in the shape of half an inverted equilateral triangle and further comprises indicia 22 having the colours red 22*r* and white 22*w* according to the international standard for a yield sign (as would be applied to a corresponding half of a yield sign). Unlike the first embodiment, however, the lateral member 20 member in this embodiment is preferably mounted on one side of the sign post 14 with the mounting edge 20*m* sandwiched between the sign post 14 and the rear of sign plate 10*p* (as more clearly shown in FIGS. 6*a* and 6*b*).

In another embodiment (not shown), the lateral member 20 does not comprise a mounting edge, but is rather a planar member with planar faces 20' and 20" and is mounted on one side of a sign post 14, with one planar face 20" abutting the post 14 and the other planar face 20' carrying suitable incidia 22.

Those of ordinary skill in the art will appreciate that various modifications to the invention as described herein will be possible without falling outside the scope of the invention. In the claims, the word "comprising" is used in its inclusive sense and does not exclude other elements being present. The indefinite article "a" before a claim feature does not exclude more than one of the features being present.

The embodiments of the invention in which an exclusive property or privilege is being claimed are defined as follows:

1. A road sign, for viewing by primary traffic and right-angled traffic driving on a ground surface, said road sign comprising:

a post having a first side and a generally opposing second side;

a sign plate having a height, a width, a center portion along said width and a first indicia representative of the sign's message directed to the primary traffic, said sign plate mounted to the first side of the post and at substantially said center portion; and a lateral member mounted to the second side of the post, said lateral member having a second indicia directed to the right-angled traffic;

wherein the lateral member is substantially the same height as said height of the sign plate;

wherein the lateral member is mounted to the post at substantially the same level above the ground surface as the sign plate; and wherein the lateral member has a width that is anywhere from 5% to 70% of said width of the sign plate.

2. The road sign of claim 1 wherein the lateral member has a width that is anywhere from 15% to a 25% of said width of the sign plate.

* * * * *